United States Patent [19]

Turner et al.

[11] Patent Number: 5,057,077

[45] Date of Patent: Oct. 15, 1991

[54] FEEDING APPARATUS

[75] Inventors: John J. Turner, Blundellsands; Mary J. A. Turner, Liverpool; Peter Watt, Wirral, all of England

[73] Assignee: National Research Development Corporation, London, England

[21] Appl. No.: 372,615

[22] Filed: Jun. 28, 1989

[30] Foreign Application Priority Data

Jun. 28, 1988 [GB] United Kingdom ..... 8815379

[51] Int. Cl.[5] ..... A61J 9/00

[52] U.S. Cl. ..... 604/77; 604/247

[58] Field of Search ..... 604/77, 79, 174, 245–247, 604/249, 257; 606/234–236; 215/11.4

[56] References Cited

U.S. PATENT DOCUMENTS

| | | | |
|---|---|---|---|
| 2,742,168 | 4/1956 | Panetti | 215/11.4 |
| 2,756,740 | 7/1956 | Deane | 604/77 |
| 2,764,155 | 9/1956 | Meyers | 215/11.4 |
| 2,868,203 | 1/1959 | Tichy . | |
| 2,969,064 | 1/1961 | Metz | 604/77 |
| 3,411,648 | 11/1968 | Tichy | 215/11.4 |
| 4,196,747 | 4/1980 | Quigley | 604/77 |
| 4,430,075 | 2/1984 | Urban et al. | 604/77 |
| 4,463,859 | 8/1984 | Greene . | |
| 4,518,382 | 5/1985 | Bloxom, Jr. | 604/257 |
| 4,796,628 | 1/1989 | Anderson | 606/236 |
| 4,813,933 | 3/1989 | Turner | 604/79 |
| 4,950,254 | 8/1990 | Andersen et al. | 604/247 |

FOREIGN PATENT DOCUMENTS

| | | |
|---|---|---|
| 2656819 | 6/1977 | Fed. Rep. of Germany . |
| WO80/00657 | 4/1980 | PCT Int'l Appl. . |
| WO86/03402 | 6/1986 | PCT Int'l Appl. . |
| 2181958 | 5/1987 | United Kingdom . |
| 2202449 | 9/1988 | United Kingdom . |

*Primary Examiner*—Stephen C. Pellegrino
*Assistant Examiner*—Ralph A. Lewis
*Attorney, Agent, or Firm*—Cushman, Darby & Cushman

[57] ABSTRACT

Apparatus for administering oral fluid from a reservoir (60) to a patient comprises: a chamber (10,30) suitably formed by connection of a mouthpiece (30) to be held adjacent the gums and/or teeth and a nipple (10) or diaphragm (310) at the mouthpiece rear for tongue activation, with fluid inlet and outlet openings (34,12) formed respectively in the former and latter; a tube (40) connected between the chamber inlet opening and reservoir; and a fluid flow control valve (50) connected in the tube, such valve suitably having a cylinder housing (51) with inlet and outlet ports (54,53) at its ends and a piston valve member (55) freely reciprocable therein a clearance fit to close and open the outlet port. The valve is preferably effectively symmetrical with a ball piston (55) reciprocable also to close and open the inlet port. The mouthpiece is preferably transversely ovate and/or forwardly dished to accommodate to its oral location, and also reticulate (32) and/or formed with peripheral incursions (33) to facilitate mouth breathing. The nipple is preferably upwardly inclined towards the palate with the outlet opening in its underside, and is suitably flattened with downward curving or chamfering towards its free end.

19 Claims, 3 Drawing Sheets

FEEDING APPARATUS

Figure 1:
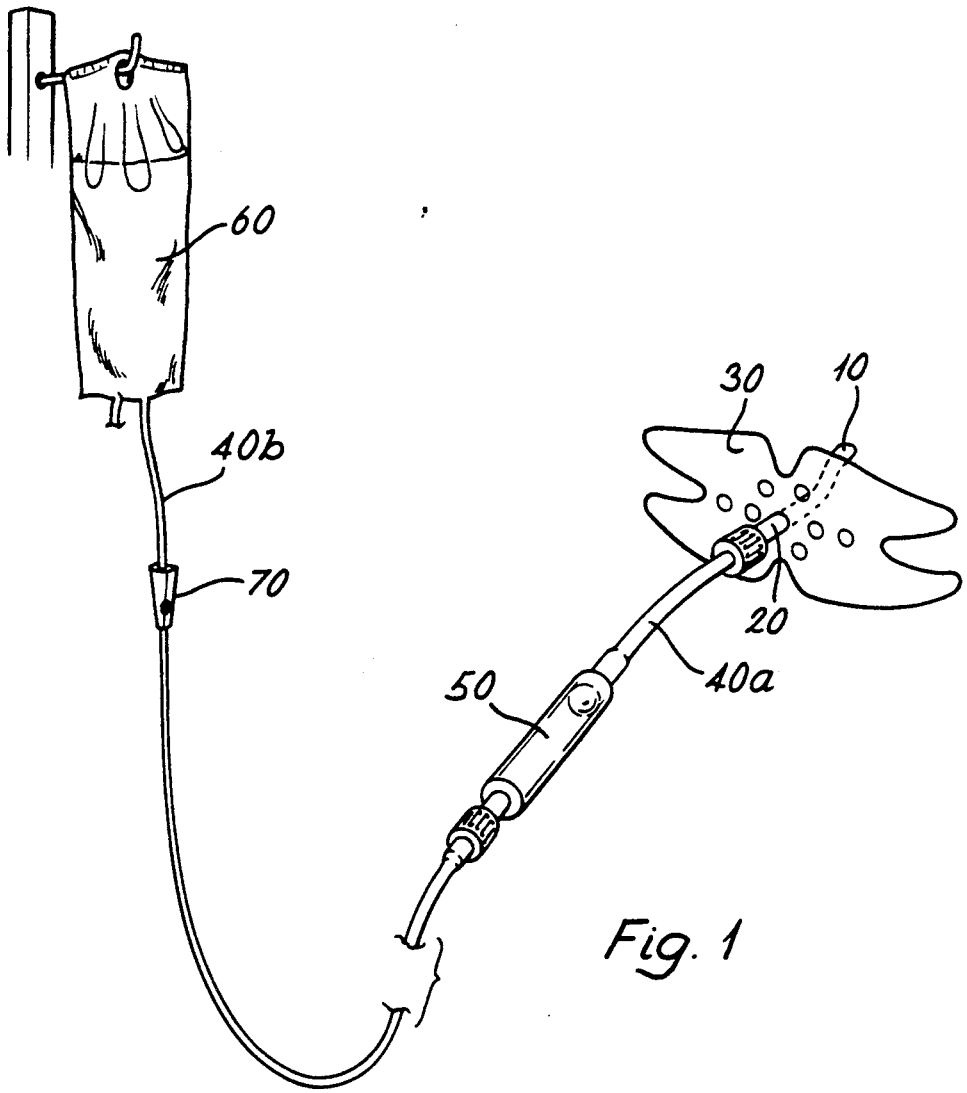

This invention concerns feeding apparatus and more particularly such apparatus for administering oral fluids.

The maintenance of an adequate level of hydration is of fundamental importance to the physical well-being of the human body. Clearly, such maintenance can be problematical for an individual who is ill and, because of physical or mental disability, has an impaired ability to drink normally. Under conventional good practice the fluid intake for the majority of patients in this category is individually administered by nursing personnel, while for the remaining minority an alternative intensive care approach involving an intravenous or nasogastric tube is appropriate. However, the reality of such practice is that the majority demand for individual administration is time consuming and places an undue strain on nursing resources and this can lead, in turn, to the adoption of an alternative intensive approach inappropriately or, perhaps worse still, failure to maintain a fully adequate hydration level.

It has been proposed in Patent Specification GB-A-2181958, that this situation be improved by the provision of a device to facilitate the administration of oral fluid to a patient, such device comprising a nipple, a soft reticulate mouthpiece shaped to be received between the lips and the teeth or gums of the patient to hold the nipple over the patient's tongue, a container for the oral fluid, the container being at a higher level than the patient's head, and a tube leading from the container to the nipple, the latter containing a valve which prevents the fluid from flowing freely out of the nipple but which is operable by the sucking action of the patient so that the oral fluid flows out of the nipple so long as the patient continues to suck.

Also it has subsequently been proposed in Patent Specification GB-A-2202449 to cater for the situation of a patient unable to sustain a sucking action to the extent which is necessary, with use of the recent prior device, to maintain an adequate liquid intake. This later proposal is for apparatus comprising a nipple, means for holding the nipple in the patient's mouth, a container for the oral fluid, a tube leading from the container to the nipple, and means responsive to the patient sucking on the nipple for metering the quantity of fluid flowing out of the nipple. In a preferred form of this apparatus the metering means comprises a pump and the control means includes a sensor responsive to an initial suction-induced flow in the tube and adapted to switch on the pump for a predetermined period to supply to the nipple a quantity of oral fluid determined by such period.

While these prior proposals represent possibilities for significant improvement in facilitating the maintenance of adequate hydration levels, such proposals, as specifically presented to date, are not without their own disadvantages. Thus, the earlier proposal is normally, as already indicated, limited in operative effect in direct dependence on a patient's ability to sustain a sucking action. At the same time, the later proposal specifically addresses this limitation, but normally resolves the limitation only through added complexity and/or cost by way of a pump and related control means.

An object of the present invention is further to improve this situation and, to this end, provides apparatus for administering oral fluid from a reservoir to a patient, comprising: a chamber adapted to be held in the patient's mouth, the chamber having a fluid inlet opening and outlet opening, and a resilient wall; a tube connected between the chamber inlet opening and an associated fluid reservoir; and a valve connected in said tube to control fluid flow through the latter, the valve including a hollow housing formed with fluid inlet and outlet ports, and a valve member in said housing, which member is freely movable into and out of engagement with said outlet port respectively to close and open the same.

In use the presently proposed apparatus will normally be set up in similar manner to the apparatus of the first Specification above with the chamber serving the role of the mouthpiece and nipple in such Specification. In this case operation is effected orally by the patient, suitably by tongue action, to distort the resilient wall of the chamber in such a manner as to reduce the volume of the latter. This use and operation is described in more detail hereinafter, but it is to be noted that the delivered bolus volume resulting from an individual operation is not necessarily directly proportionately related to parameters of the patient action. In any event the apparatus is advantageous in being applicable to a wider range of patients than that of the first prior proposal by virtue of a capability for use by weaker patients, but without the need for special measures or additions such as a pump as with the later prior proposal.

Also the apparatus, in a preferred form, can be set up for use in an alternative manner to facilitate drinking as by way of a straw. In the result the apparatus is further advantageous in being applicable for use by stronger patients who are not necessarily or no longer in need of the apparatus in its first or normal mode of use.

Preferably the valve takes the form of a piston and cylinder assembly with the housing forming the cylinder and the valve member serving as a piston. Unlike the more usual case for a piston and cylinder assembly, the valve member piston is reciprocable within its housing cylinder in a clearance fit rather than sealed manner. Also, the outlet port is appropriately located at one end of the chamber cylinder, with the piston reciprocable into and out of closing engagement with such port. The inlet port is conveniently located at the other end of the cylinder, preferably to provide a symmetrical structure to the extent that this port also can be closed and opened by piston reciprocation. In this last event it is preferable also for the piston to be of symmetrical form, and the piston is most appropriately a ball for this and other purposes. It is also preferred that the cylinder have at least one groove extending longitudinally therein between its ports.

The chamber can, as in the first Specification above, involve a mouthpiece formed to serve as a gingival sulcus bridge whereby the chamber is held in the mouth with the mouthpiece adjacent the teeth and/or gums. To this end the mouthpiece is suitably of a generally sheet formation and it can vary between lesser and more extensive frontal shapings, as between circular, say, and generally ovate. Also to accommodate to the relevant oral shaping, the mouthpiece is suitably of a flexible material, which additionally aids comfort. Alternatively, or additionally, the mouthpiece can be preshaped to a curved or dished form, and the sheet can be tapered towards its periphery.

When more extensive, the mouthpiece is preferably reticulate and/or has incursions in its peripheral shaping to facilitate breathing through the mouth.

Retention in the mouth can also be facilitated, particularly with a less extensive mouthpiece, by connection with the mouthpiece of a relatively stiff portion of tube which bends through about 90° to pass, in use, from the mouth, downwardly over and adjacent the chin. This tube also acts to determine and stabilise the orientation of the mouthpiece and to inhibit undesirable movement into the mouth.

The chamber can, also as in the first Specification above, include a nipple to serve as the resilient wall of the former. Preferably such a nipple is connected with the mouthpiece to incline upwardly towards the palate in use to facilitate squeezing of the nipple against the palate by tongue action. Preferably also in this case the inclined nipple has its upper portion downwardly tapered in curved or chamfered manner to seat on the palate. Also, the chamber outlet opening is preferably located in the nipple to facilitate is occlusion when the nipple is squeezed, with the opening being best sited in the nipple underside for direct occlusion by tongue action.

Alternatively, and preferably, the resilient wall of the chamber is provided in the form of a diaphragm, suitably in association with and spanning part of a dished mouthpiece, this diaphragm being operated by pushing with the tip of the tongue. Again the chamber outlet opening is preferably sited in the diaphragm for direct occlusion by tongue action.

The above and other features of the present invention are clarified, by way of example, with reference to the accompanying drawings, in which:

FIG. 1 illustrates one embodiment of apparatus according to the invention set up for use by normal operation.

Figure 2:
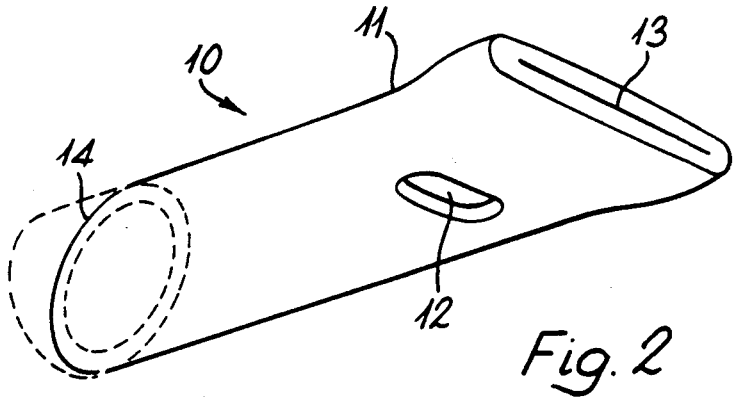
Figure 3:
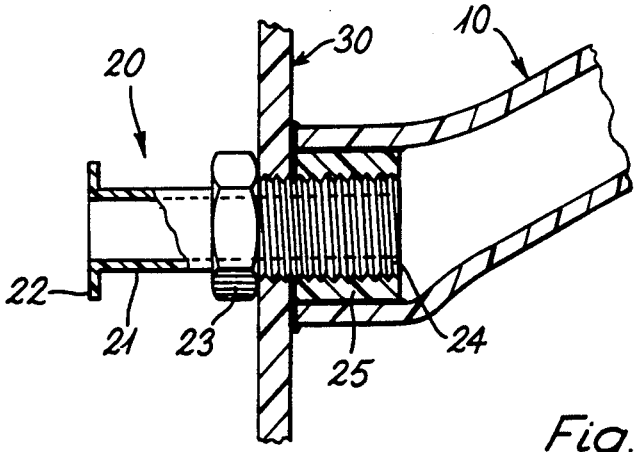
Figure 4:
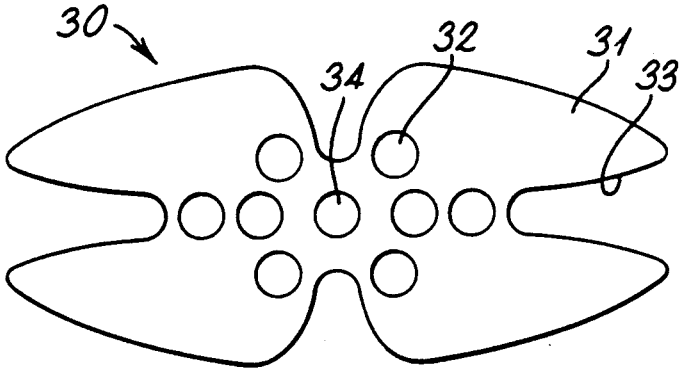
Figure 5:
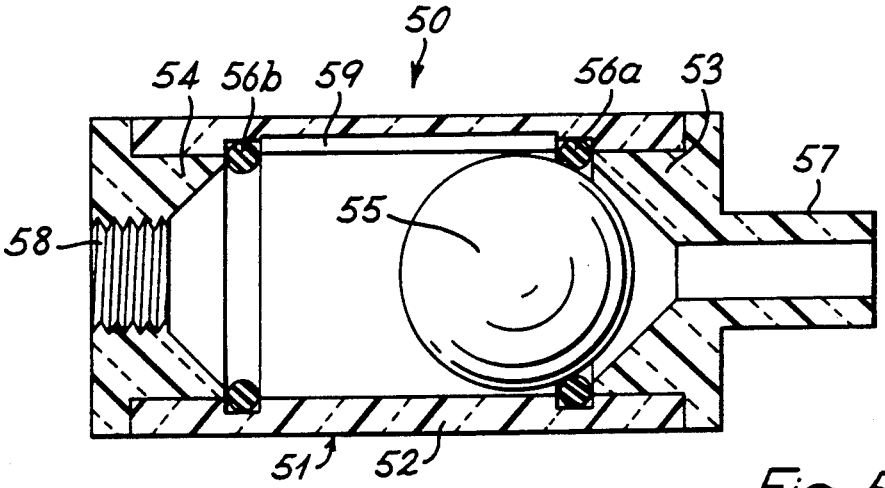
Figure 6A:
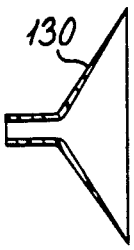
Figure 6B:
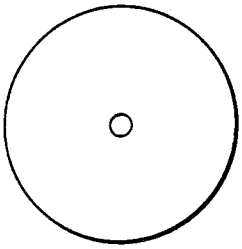
Figure 7A:
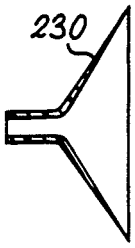
Figure 7B:
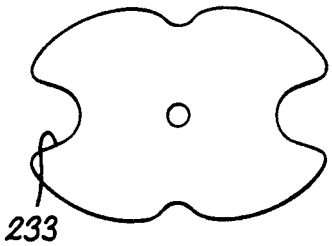
Figure 8A:
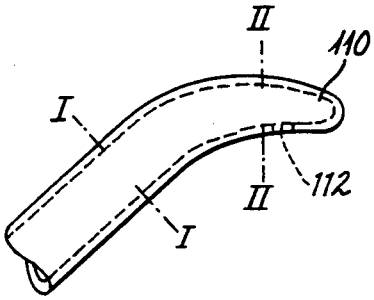
Figure 8B:
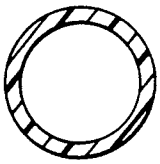
Figure 8C:
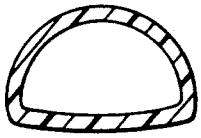
Figure 9:
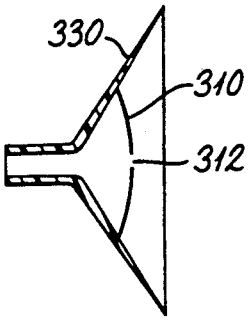
Figure 10A:
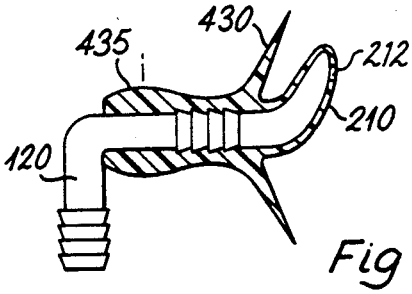
Figure 10B:
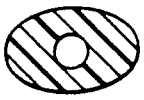

FIGS. 2, 3 and 4 respectively illustrate in perspective, cross section and front elevation, a nipple, connector and holding means suitable for use in FIG. 1, FIG. 5 illustrates in cross section a valve suitable for use in FIG. 1, FIGS. 6*a* and 6*b* respectively illustrate in cross-section and front elevation a modified mouthpiece, FIGS. 7*a* and 7*b* similarly illustrate a further-modified mouthpiece, FIGS. 8*a* 8*b* and 8*c* respectively illustrate in a longitudinal and two transverse cross sections a modified nipple, FIG. 9 illustrates a modified mouthpiece/diaphragm combination, and FIGS. 10*a* and 10*b* respectively illustrates by two sections a modified connector and mouthpiece/nipple combination.

The apparatus of FIG. 1 shows a sequential connection of elements which include, progressing proximally from a patient (not shown) who is to use the apparatus, a nipple 10, mounted by a connector 20 with a mouthpiece 30, and communicated through a first stage tube 40*a* to a valve 50, and then on through a second stage tube 40*b* to a fluid reservoir 60. The tube stages 40 are of flexible tubular plastics material such as used in association with drip sets or other equipment for supply of fluid to patients. Tube stage 40*a* is preferably of thicker walled form than stage 40*b* better to resist bending. The reservoir 60, similarly, is of conventional bag or bottle form as used in such equipment. Also, it can be appropriate to fit a tube clamp 70, of known form from such equipment, to the second stage tube whereby the tube can be selectively opened and closed.

The remainder of the elements of FIG. 1 are illustrated by example in more detail in FIGS. 2–5, but it is appropriate before describing these elements to note the apparatus set up in FIG. 1. In this last connection the nipple and mouthpiece combination is, of course, to be located for application to the patient's mouth and this latter will typically be at 'bed' height. The reservoir is to be located at a relatively greater height, suitably by at least a distance approaching the order of one metre, to provide for liquid flow by gravity as with drip sets. The tube stages depend between these terminal elements generally in the manner of a U-bend, with the first stage tube being of adequate length that the valve can readily depend longitudinally in a non-horizontal relatively upright manner from the bed or other patient support.

The nipple 10 of FIG. 2 has a body 11 formed from a length of silicone rubber tubing in which a relatively small orifice 12 is cut nearer to one end of the tube. The one end of the tube has an end face 13 perpendicular to the tube axis and this end is flattened and bonded to seal the same, with the plane of this flattening being substantially parallel to that of the orifice. At the other end the tube has an end face 14 which is inclined in a plane extending upwardly and forwardly towards the one end.

An indication of more specific detail appropriate for the nipple 10 is given by reference to an embodiment which has proved satisfactory in initial development of the invention. For this embodiment the tube was of "Portexsil" silicone rubber tubing of 5×7 mm diameter and 30 mm overall length, with an orifice of 3 mm diameter located 10 mm from the flattened end face, and the open end face inclined at 60° from the tube axis.

The connector 20 of FIG. 3 has a body 21 of generally tubular form with one end portion 22 externally shaped as a female Luer terminal leading, through a nut formation 23, to an externally threaded portion 24 at the other end. The mouthpiece 30 is located over the threaded portion, by way of a central opening in the former, to engage against the nut. The mouthpiece is secured in this position by engagement of an internally threaded sleeve 25 on the connector threaded portion, the open end of the nipple is located over the sleeve in appropriate orientation, and the mouthpiece, sleeve and nipple are bonded together.

The mouthpiece 30 of FIG. 4 has a body 31 of generally ovate sheet form having an array of relatively small orifices 32 in its central region. The body is suitably preformed with flexible material to be curved along the major axis of its ovate shape. Also, as shown, the edge periphery of the body is smoothly curved with an individual inwardly tapered incursion 33 along each end portion of its major and minor axes, with each such incursion extending about halfway towards the centre of the body. The array of orifices is suitably located within the region of the body bounded by the inner ends of the peripheral incursions, and around a central orifice 34 which serves for mounting on the connector 20. Conveniently, the resultant body shape is symmetrical about its principal axes.

In use the major axis of the body 31 should be generally parallel with the plane of the nipple orifice 12.

An indication of more specific detail appropriate for the mouthpiece 30 is given by reference to an embodiment used in connection with the detailed nipple of FIG. 2. In this embodiment the body was made of "Silastic" medical grade silicone rubber sheeting of 1.5 mm thickness, with ovate axial dimension of 90 and 40 mm, and orifices of 5 mm diameter.

The valve 50 of FIG. 5 comprises a piston and cylinder assembly constituted by a housing 51 formed by a hollow circular cylindrical body 52 and end plugs 53, 54 bonded therein as the cylinder, and a ball valve element 55 as the piston. The ball is a clearance fit in the body, and the end plugs are each bored to define ports through which the valve is communicated with the tube stages 40 in FIG. 1 for fluid flow through the valve.

One end plug, 53, defines the outlet port referred to earlier above, this plug having secured adjacent its inner end within the body an O-ring seal 56*a* against which the ball can seat to close the relevant port. At its outer end, this plug has a projecting sleeve 57 around which the associated end of the first stage tube 40*a* is to be secured. The other end plug, 54, is of similar form, with a respective further O-ring 56*b*, but has the outer end portion of its inlet port bore threaded at 58 for receipt of a female Luer connector whereby the associated end of the second stage tube 40*b* is connectable.

An indication of more specific detail appropriate for the valve 50 is given by reference to embodiments used in initial development of the invention with apparatus as so far just described. In these embodiments the ball was of PTFE and 9.7 mm diameter, and the body of "Perspex", 10 mm internal diameter, and length from 30 to 84 mm.

Turning to the matter of operation: with the apparatus as so far described set up according to FIG. 1, and the nipple/mouthpiece located in a patient's mouth, fluid from the reservoir acts by gravity to move the valve ball to seat against the outlet seal 56*a* and to close the outlet port. In these circumstances operation by patient tongue actuation to squeeze the nipple against the palate will flatten the nipple and, at the same time, occlude the nipple outlet orifice by the nipple flattening and/or covering the orifice with the tongue. This generates a pressure pulse which travels into the valve to unseat the ball and allows this to move under gravity away from the outlet port. Termination of this action releases the nipple and fluid flows to and through the valve to exit from the nipple outlet orifice into the patient's mouth. At the same time this flow moves the ball back towards its seating for outlet port closure, whereat fluid flow terminates.

A benefit of this operation is that the resultant fluid bolus which is delivered need not necessarily be of a volume directly proportionate to parameters of the causory patient action as is the case with the first prior proposal mentioned above. In the present case the bolus volume will depend on factors including the freedom of movement of the ball within its chamber in terms of stroke and clearance, the viscosity of the fluid, the resistance of the nipple to squashing, and the strength and duration of the patient action. It has in fact been found that those of such factors involving the nipple and valve can without undue difficulty provide an apparatus readily operable by patients of a weakness down to the level at which alternative intensive measures become appropriate, with a range of fluids appropriate to patient care, and with bolus volume being determined primarily by ball stroke. Moreover, it is considered practicable to select this last factor whereby the great majority of patients for whom the apparatus is appropriate can operate the apparatus consistently to deliver a bolus of satisfactory volume.

In this last connection it is to be understood that a satisfactory bolus volume is one which is large enough to allow a patient to sustain an adequate hydration level without undue effort, but not so large as to be incompatible with the patient's ability to swallow without risk of choking. An appropriate bolus volume for this purpose is considered to be in the range 1–4 ml.

The satisfactory nature of the invention in this last respect is indicated by results attained during trial with embodiments such as described so far. Operation with the valve of FIG. 5 having a body length of 30 mm produced, with water as the fluid from a reservoir elevated above the nipple by about 1 m, delivered bolus volumes of substantially 2.5 ml with the valve disposed vertically and 1.5 ml with the valve disposed horizontally. Corresponding operation with a valve body length of 54 mm gave respective bolus volumes of 4 ml and 2.5–3 ml.

This trial also involved the use of fluids other than water, including milk and nutrient mixtures. A difficulty arose with more viscous forms of such fluids in that the ball movement away from the associated seal was not always consistent and this was found to be due to entrapment of air bubbles below the ball. Resolution was found possible by breaking up larger air bubbles and bleeding when setting up, but this is not desirable for routine usage. An alternative more satisfactory resolution was found possible by enlarging the chamber interior extending between the seals to allow bubble escape. This alternative is associated with a need for increased reservoir elevation and a further, presently preferred approach involves the provision of one or more small axial grooves within the valve body, one such groove being indicated at 59 in FIG. 5.

Regarding the alternative mode of use mentioned earlier above for the present invention, this involves supply of fluid from a reservoir at or below the level of the patient's mouth. In these circumstances suction effort simply to draw fluid into the mouth effects delivery as by a straw but with the added benefit that, upon cessation of sucking, fluid does not wholly flow back into the reservoir. An initial reverse flow and gravitational effect locate the valve ball on its inlet seal 56*b* to stop continued reverse flow, the ball being elevated from this seal during fluid flow by patient action.

The embodiment of FIGS. 1–5 in fact represents an early form of the present invention and further development has given rise to other forms and variations.

One area of further development involves the mouthpiece. The mouthpiece of FIG. 4 has been produced by cutting from sheet latex rubber and variations in sizing and shape are possible with the same mode of manufacture. However, manufacture by moulding allows yet further variations among which preforming to curved and dished forms are found advantageous. More particularly, a dished form conforms better with the natural oral shaping and facilitates comfort.

Two dished forms of mouthpiece are shown in FIGS. 6 and 7, each cross-section and front views (a) and (b) respectively.

In FIG. 6 the mouthpiece 130 is of conical form with its wall extending in tapered manner to a circular base. Specific detail of one satisfactory embodiment of this form entailed an apex angle of 120° and a circular base diameter of 40 mm.

In FIG. 7 the mouthpiece 230 is of similar conical form but is extended to a generally ovate base with incursions 233 at least at the ends of the major axis of the latter. Specific detail of one satisfactory embodiment of this form also entailed a 120° apex angle, and ovate base dimensions of about 50×35 mm.

Both of these forms allow mouth breathing therearound by widening the mouth beyond the edge of the mouthpiece in an action similar to that of smiling.

Another area of development involves the nipple. The form of FIG. 2 has been improved, again by moulding for manufacture, to have its free end portion downwardly tapered in curved or chamfered manner to seat on the palate in use. Such tapering suitably accompanies an increase in nipple inclination to the order of 50° relative to its connector axis. Also, in a preferred form, such a nipple is moulded to progress from rounded cross sectional shape adjacent its connector to a flattened shape towards its free end.

One embodiment 110 of this nipple form, with outlet orifice 112 is shown in FIG. 8 by way of a longitudinal cross section (a) and transverse cross sections (b) and (c) taken respectively at I—I and II—II of the former.

In a yet further and now perferred development the nipple is reduced to the form of a resilient diaphragm extending across the central part of a dished mouthpiece. Such a diaphragm, like the nipples described above, suitably has an orifice and is operated by distorting the diaphragm and occluding its orifice. However, rather than a squeezing operation against the palate, the diaphragm is pushed into the mouthpiece with the tip of the tongue.

FIG. 9 shows in schematic cross section one embodiment of such a diaphragm at 310, with an orifice 312, connected within a mouthpiece 330 of dished form.

A further area of development involves the connector and this is preferably formed with a bend of about 90° as mentioned earlier above. Also, the connector suitably takes a simplified form for push-fit connection with a mouthpiece formed with a forward tubular projection for this purpose. At the same time such projection is preferably formed with ovate outer cross-sectional shape, with the major axial direction being orientated orthogonally of the connector bend and across the width of the mouth in use. This shaping affords enhanced conformity with natural oral shaping to facilitate sealed engagement between the lips.

FIG. 10 shows at (a) one embodiment of such a connector 120 in connection with a one-piece moulding of dished mouthpiece 430 with projection 435 and an inclined nipple 210 having an outlet orifice 212, and at (b) the cross-sectional shape of projection 435. It is to be noted that this embodiment represents an evolutionary stage in the development from use of a nipple to use of a diaphagm.

While the invention has been described with more particular reference to the illustrated embodiments, it is clearly open to variation in detailed form. Some such variation is evident from the embodiments themselves, and yet others are possible and indeed may be desirable for commerical production. For example, the valve housing structure can be designed for snap-fit assembly by the integration of some parts for production by moulding.

We claim:

1. Apparatus for administering ingestible oral fluid to a patient, comprising:

a chamber adapted to be held in the patient's mouth, the chamber having a fluid inlet opening directed outwardly of the mouth when so held, a fluid outlet opening and a resilient wall directed inwardly of the mouth;

an oral fluid reservoir separate from the chamber and adapted to be elevated relative to the patient's mouth;

a tube connected between the chamber inlet opening and the reservoir; and a valve connected in said tube to control fluid flow through the tube from the reservoir to the patient, the valve including a hollow housing formed with a fluid inlet port and a fluid outlet port wherein the inlet port is positioned upstream of the outlet port, and a valve member in said housing, which member is freely movable into and out of engagement with said outlet port respectively to close and open the same;

the valve normally being operable under fluid pressure from the reservoir to move the valve member to close the outlet port, but being operable in response to distortion of the chamber resilient wall by patient oral action to move the valve member to open the outlet port and initiate fluid flow to the patient, with such flow continuing in predetermined metered manner independently of sustained patient action.

2. Apparatus according to claim 1 wherein said valve housing and member are respectively in the form of a cylinder and a piston therein, said fluid outlet port being located in one end of said cylinder, and said piston being reciprocable in a clearance fit in said cylinder.

3. Apparatus according to claim 2 wherein said fluid inlet port is located in the other end of said cylinder, and said piston is reciprocable to close and open such port.

4. Apparatus according to claim 3 wherein said cylinder has at least one groove extending longitudinally therein between said ports.

5. Apparatus according to claim 2 wherein said piston is of ball form.

6. Apparatus according to claim 1 wherein said chamber includes a mouthpiece of generally sheet form to be held in the mouth as a gingival sulcus bridge adjacent the gums and/or teeth.

7. Apparatus according to claim 6 wherein said mouthpiece is of generally circular or ovate form in front view relative, in use, to the patient's mouth.

8. Apparatus according to claim 6 wherein said mouthpiece is of dished form opening, in use, inwardly of the patient's mouth.

9. Apparatus according to claim 8 wherein said chamber resilient wall comprises a diaphragm spanning part of said mouthpiece and having said outlet opening formed therein.

10. Apparatus acccording to claim 6 wherein said mouthpiece is of reticulate form to facilitate mouth breathing.

11. Apparatus according to claim 6 wherein said mouthpiece is formed with incursions from its periphery.

12. Apparatus according to claim 6 wherein said mouthpiece is of generally ovate shape in front view relative, in use to the patient's mouth, dished form opening inwardly of the mouth, and has incursions from its periphery at least at the ends of the major access of said ovate shape.

13. Apparatus according to claim 6 wherein said mouthpiece has a forward projection therefrom for location between the lips, such projection having a transverse profile of generally ovate shape, and such shape extending generally parallel with any similar shape in the mouthpiece sheet form.

14. Apparatus according to claim 6 wherein said chamber resilient wall comprises a nipple projecting rearwardly from said mouthpiece and having said outlet opening formed therein.

15. Apparatus according to claim 14 wherein said nipple is inclined, in use, upwardly away from said mouthpiece towards the palate.

16. Apparatus according to claim 15 wherein said outlet opening is located in the underside of said nipple.

17. Apparatus acccording to claim 15 wherein the free end portion of said nipple is of transversely flattened form.

18. Apparatus according to claim 17 wherein said free end portion is downwardly tapered in curved or chamfered manner.

19. Apparatus according to claim 6 wherein said mouthpiece has a tubular connector projecting forwardly therefrom, said connector bending through about 90° to depend from the mouth over and adjacent the chin, and being stiff relative to said tube with which it connects.

* * * * *